US010697253B2

(12) United States Patent
Bartos et al.

(10) Patent No.: US 10,697,253 B2
(45) Date of Patent: Jun. 30, 2020

(54) BLAST RESISTANT MATERIAL

(71) Applicant: Cameron International Corporation, Houston, TX (US)

(72) Inventors: John Charles Bartos, Magnolia, TX (US); Omar M. Kabir, Waller, TX (US)

(73) Assignee: Cameron International Corporation, Houston, TX (US)

( * ) Notice: Subject to any disclaimer, the term of this patent is extended or adjusted under 35 U.S.C. 154(b) by 637 days.

(21) Appl. No.: 14/959,448

(22) Filed: Dec. 4, 2015

(65) Prior Publication Data

US 2017/0159376 A1 Jun. 8, 2017

(51) Int. Cl.

| | |
|---|---|
| ***E21B 19/00*** | (2006.01) |
| ***F41H 5/06*** | (2006.01) |
| ***E21B 41/00*** | (2006.01) |

(52) U.S. Cl.

CPC ..... *E21B 19/00* (2013.01); *E21B 41/0021* (2013.01); *F41H 5/06* (2013.01)

(58) Field of Classification Search

CPC ..... E21B 19/00; E21B 41/0021; F41H 5/06

USPC ..... 166/75.11

See application file for complete search history.

(56) References Cited

U.S. PATENT DOCUMENTS

| | | | | |
|---|---|---|---|---|
| 4,046,406 | A * | 9/1977 | Press | F16L 59/145 137/375 |
| 4,413,683 | A * | 11/1983 | Hune | A62C 3/00 137/382 |
| 4,428,440 | A | 1/1984 | McPhee | |
| 5,462,114 | A | 10/1995 | Catanese, Jr. | |
| 2007/0262029 | A1 * | 11/2007 | Yoshida | B01D 61/025 210/741 |
| 2010/0196671 | A1 | 8/2010 | Sorensen et al. | |
| 2014/0123842 | A1 * | 5/2014 | Kahmann | F41H 5/026 89/36.02 |

FOREIGN PATENT DOCUMENTS

| | | | | |
|---|---|---|---|---|
| CA | 2404739 | A1 | 1/2003 | |
| CA | 2542025 | A1 | 5/2005 | |
| WO | 9919653 | A1 | 4/1999 | |
| WO | WO-9919653 | A1 * | 4/1999 | B29C 70/086 |

OTHER PUBLICATIONS

PCT International Search Report & Written Opinion for PCT Application No. PCT/US2016/064493 dated Apr. 11, 2017; 16 Pages.

* cited by examiner

*Primary Examiner* — Anna M Momper
*Assistant Examiner* — Patrick F Lambe
(74) *Attorney, Agent, or Firm* — Fletcher Yoder, P.C.

(57) ABSTRACT

A system includes an enclosure defining an inner volume comprising a blast-resistant material having a metallic layer, wherein the metallic layer has substantially zero elongation, and a polymer layer coupled to the metallic layer and a pressure containing component disposed within the inner volume of the enclosure.

20 Claims, 3 Drawing Sheets

BLAST RESISTANT MATERIAL

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Mineral extraction systems use various devices that may experience, contain, and/or withstand elevated pressures. For example, mineral extractions systems may include flow control devices (e.g., valves, chokes, etc.) to control fluid (e.g., oil or gas) flow in mineral extraction operations. Flow control devices typically control pressure and fluid flow into flowlines, which then move the extracted minerals to processing plants or other locations. Mineral extraction systems may also include other components designed to experience, contain, and/or withstand elevated pressures, such as compressors, turbomachines, vessels, or other pressurized components. Such pressurized devices may first be tested before use in the field to evaluate and/or verify the pressure containing capability of such devices. Unfortunately, pressure containing devices may be susceptible to degradation and/or failure during testing and/or use in the field (e.g., use with a mineral extraction system).

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The disclosed embodiments include a blast-resistant material, which may be used to form an enclosure about a pressure containing device or component. For example, the blast-resistant material may be polymer based, metallurgical based, or a combination thereof. The blast-resistant material may also be rigid or compliant. In other words, the blast-resistant material may be a stiff and/or inflexible barrier (e.g., a sheet or panel), or the blast-resistant material may be a pliable sheet (e.g., a blanket or wrap) configured to conform to a pressure containing device. As discussed in detail below, the blast-resistant material may be used to create a barrier about or around a pressure containing device, such as a component of a mineral extraction system. For example, the pressure containing device may be a valve, vessel, turbomachine, or other pressure containing apparatus. In certain embodiments, the blast-resistant material may be used to create an enclosure surrounding the pressure containing device during pressure testing (or other testing) of the pressure containing device. In other embodiments, the blast-resistant material may be used to create a shield around the pressure containing device during use of the pressure containing device in the field. The blast-resistant material functions to contain potential projectiles or other debris that may disperse in the event of deterioration in the pressure containing performance of the pressure containing device. As discussed in detail below, the blast-resistant materials disclosed herein may have improved energy absorption capabilities over traditional materials. Additionally, the blast-resistant materials disclosed herein may be more lightweight, maneuverable, and/or otherwise suitable for mineral extraction system applications over existing materials.

Figure 1:
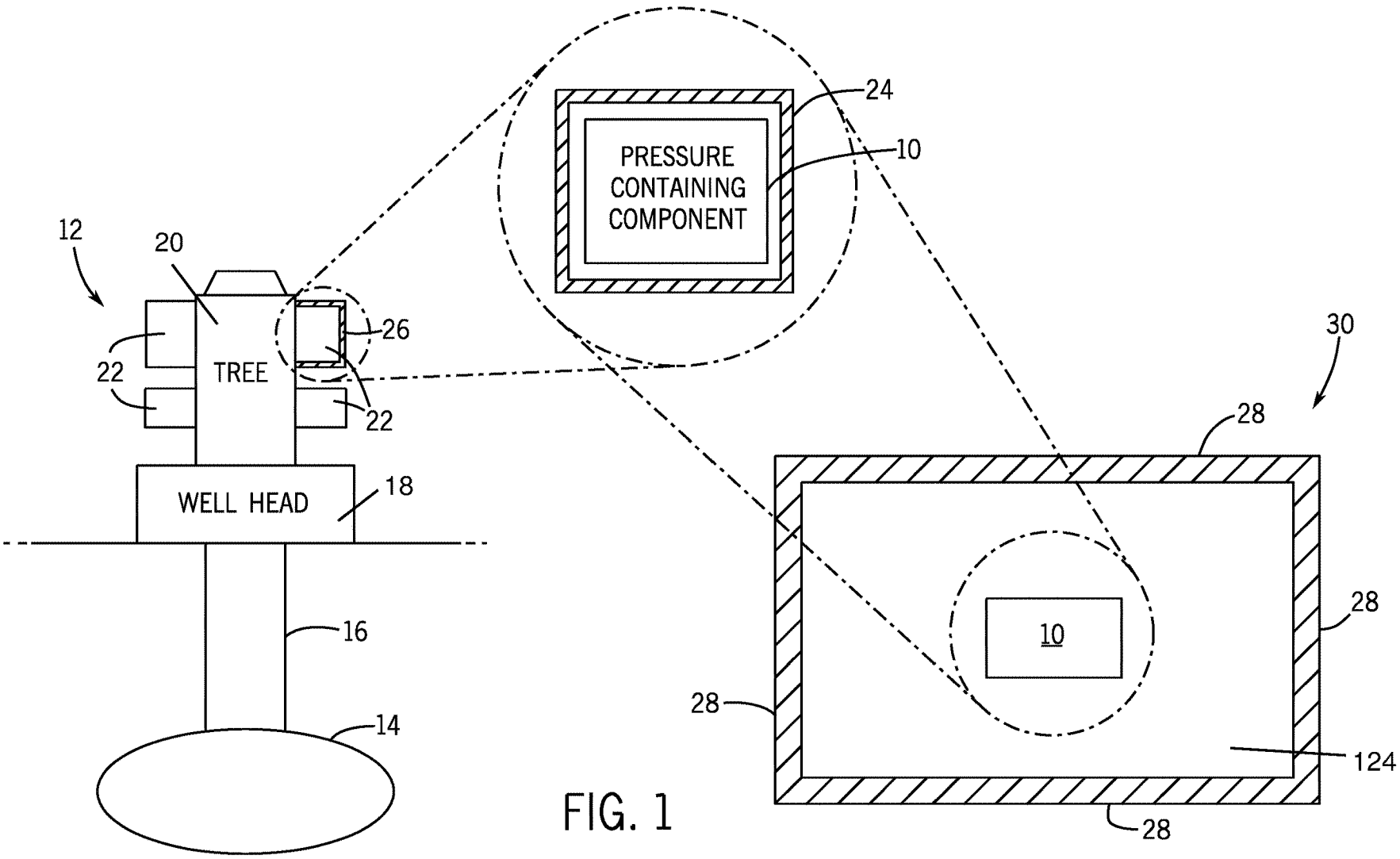
FIG. 1 is a schematic diagram of a pressure containing component, which may be a component of a mineral extraction system, having a blast-resistant barrier, in accordance with an embodiment of the present disclosure.

FIG. 1 is a schematic diagram of a pressure containing component 10, which may be used with a variety of different systems, such as a mineral extraction system 12. The pressure containing component 10 may be any component or device that contains, withholds, and/or retains pressure. For example, the pressure containing component 10 may be a fluid control device, such as a valve, a compressor, other turbomachine, or other vessel configured to contain pressure (e.g., a pressurized fluid, liquid, gas, etc.).

In certain embodiments, the pressure containing component 10 is a component of the mineral extraction system 12. As will be appreciated, the mineral extraction system 12 facilitates extraction of oil, natural gas, and other natural resources from a natural resource reservoir 14 through a well 16. The illustrated mineral extraction system 10 includes a wellhead 18, a Christmas tree 20, and a plurality of valves 22. In operation, the mineral extraction system 10 controls the ingress of egress of fluids between the subterranean well 16 and the surrounding environment. As such, one or more components of the mineral extraction system 10 controls the pressure and flow rate of the extracted fluids and minerals. In the illustrated embodiment, the pressure containing component 10 is one of the valves 22. However, in other embodiments, the pressure containing component 10 may be any other component of the mineral extraction system 12, such as a component of the wellhead 18, the tree 20, or another component of the mineral extraction system 12, such as a turbomachine (e.g., a compressor or turbocharger).

As mentioned above, present embodiments include a blast-resistant material 24, which may be used to form an enclosure or cover disposed about the pressure containing component 10. The blast-resistant material 24 may be polymer based, metallurgical based, or a combination thereof. As discussed in detail below, the blast-resistant material 24 includes a material configured to absorb and distribute a force across a surface of the blast-resistant material. In other words, in the event of deterioration in the pressure containing performance of the pressure containing component 10 (e.g., a rupture the pressure containing component 10), the blast-resistant material 24 may absorb the force of the expanding pressure containing component 10 and distribute the force of the pressure containing component 10 across the blast-resistant material 24. As a result, the blast-resistant component 10 may contain released pressure and the pressure containing component 10 (e.g., fragments of the pressure containing component 10) in the event of deterioration in the pressure containing performance of the pressure containing component 10. The material composition of the blast-resistant material 24 is discussed in further detail below.

The blast-resistant material 24 may be used in a variety of applications and manners. For example, the blast-resistant material 24 may be rigid or compliant. In one embodiment, the blast-resistant material 24 may be used to form a blanket, wrap, or other compliant cover 26 that may be closely disposed (e.g., folded) about the pressure containing component 10 (e.g., valve 22). The complaint cover 26 formed from the blast-resistant material 24 may be non-intrusive and lightweight to enable use of the blast-resistant material 24 without otherwise interrupting or affecting the operation of the pressure containing component 10 and/or the mineral extraction system 12. In this manner, the blast-resistant material 24 may conveniently provide an additional level or layer of safety for the pressure containing component 10.

In another embodiment, the blast-resistant may be used to form a rigid layer 28, such as a sheet, panel, plate, slab, or other rigid surface. For example, the multiple rigid layers 28 made of the blast-resistant material 24 may be used to form an enclosure 30, such as a bunker (e.g., having four sides with or without a ceiling), in which the pressure containing component 10 may be tested (e.g., pressure tested). In certain embodiments, the pressure containing component 10 may be pressure tested (e.g., pressurized) to failure to qualify and/or verify the pressure containing capability of the pressure containing component 10. In such an application, the multiple rigid layers 28 formed form the blast-resistant material 24 function as a shield to contain potential projectiles or other debris that may disperse in the event of deterioration in the pressure containing performance of the pressure containing component 10. As discussed in detail below, the multiple rigid layers 28 of the blast-resistant material 24 may be more lightweight and/or more cost-effective than traditional enclosures (e.g., bunkers) used during pressure testing of components and devices.

Figure 2:
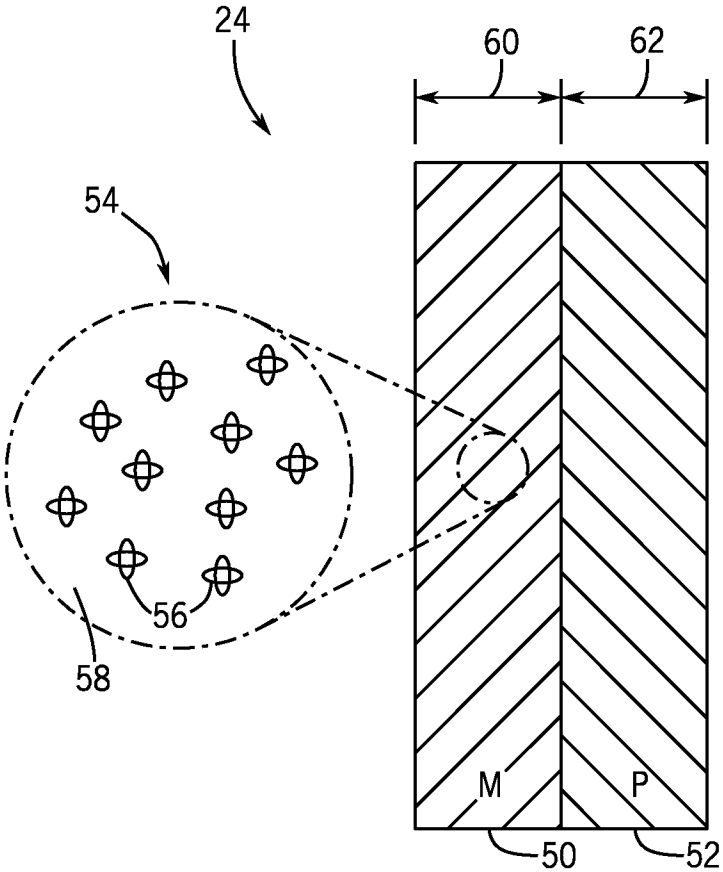
FIG. 2 is a schematic side view of a blast-resistant material, which may be used to form a blast-resistant barrier, in accordance with an embodiment of the present disclosure.

FIG. 2 is a schematic side view of an embodiment of the blast-resistant material 24. As mentioned above, the blast-resistant material 24 may be polymer based, metallurgical based, or a combination thereof. In the illustrated embodiment, the blast-resistant material 24 includes a metallic layer 50 and a polymer layer 52. The metallic layer 50 and the polymer layer 52 may be bonded to one another by an adhesive or manufactured using an additive manufacturing process (e.g., by making hybrid material layers, such as predetermined layer(s) of metallic and polymer type). The blast-resistant material 24 may also include other suitable materials, such as lightweight materials that can include diffused surface treatments, such as corrosion resistant chemicals (e.g., Nanowear), ceramic materials, and/or other materials diffused on the surface of the material. In some embodiments, the metallic layer 50 and/or the polymer layer 52 may include diffused surface treatments (e.g., corrosion resistant chemicals, ceramics, etc. that may be diffused on the respective surfaces of the metallic layer 50 and/or the polymer layer 52.

The metallic layer 50 may be a pure metallic material, or the metallic layer 50 may be a composite material 54. In other words, the composite material 54 of the metallic layer 50 may include a reinforcing material 56 distributed within a matrix material 58. As shown, the matrix material 58 is a base material that holds the reinforcing material 56. In other words, the matrix material 58 surrounds and supports the reinforcing material 56. For example, the matrix material may be a metal, such as aluminum, or other lightweight metallic material. The reinforcing material 56 is distributed throughout the matrix material 58 and may serve to enhance the physical and/or mechanical properties of the composite material 54. For example, the reinforcing material may be fibers or other particles, such as carbon, glass, ceramics, or other reinforcing material. In one embodiment, the reinforcing material 56 may be spherical glass fibers. As will be appreciated, the ratio of matrix material 58 to reinforcing material 56 may vary for different composite materials 54. For example, the ratio of matrix material 58 to reinforcing material 56 may be approximately 10:1 to 1:10, 5:1 to 1:5, 3:1 to 1:3, 2:1 to 1:2, or 1:1.

In certain embodiments, the metallic layer 50 (e.g., the composite material 54) may be configured to absorb a force and distribute the force across the entire or substantially across the entire metallic layer 50 (e.g., across the entire substantially across the entire dimensions of the metallic layer 50). For example, the metallic layer 50 may be configured to transfer kinetic energy of the force (e.g., the force of a projectile) into heat or thermal energy. To this end, the metallic layer 50 may have zero or substantially zero elongation (e.g., 0.0005, 0.0004, 0.0003, 0.0002, or less elongation). In other words, the metallic layer 50 may be essentially non-ductile. As will be appreciated, such material characteristics enable the absorption and the distribution of kinetic energy by the metallic layer 50 without plastic deformation of the metallic layer 50. These material characteristics (e.g., zero or substantially zero elongation and/or non-ductility) may be achieved by selecting an appropriate matrix material 58 and reinforcing material 56 to form the composite material 54 of the metallic layer 50, as well as an appropriate ratio of matrix material 58 to reinforcing material 56. For example, the matrix material 58 may be aluminum, and the reinforcing material 56 may be spherical glass fibers. In addition to the material characteristics described above, such a composite material 50 may be lightweight and low cost.

The polymer layer 52, which is adhered to or manufactured using additive manufacturing process as defined earlier, the metallic layer 50, may be any suitable polymeric material having high resiliency and/or high damping characteristics. The polymer layer 52 functions to further absorb force experienced by the blast-resistant material 24, such as a force imparted by a projectile. Additionally, the polymer layer 52 may help block the metallic layer 50 from fragmenting, shattering, or otherwise break into two or more pieces during a force absorption event.

As shown, the metallic layer 50 has a thickness 60, and the polymer layer 52 has a thickness 62. The thicknesses 60 and 62 may vary depending on various circumstances or parameters, such as the particular application for which the blast-resistant material 24 may be used. For example, in an embodiment where the blast-resistant material 24 is used as a rigid structure (e.g., for a wall of a bunker or other enclosure used for pressure testing of the pressure containing component 10, such as rigid layers 28), the thicknesses 60 and 62 may each be approximately 0.2 to 5, 0.3 to 4, or 0.5 to 3 inches, or any other ratios depending on the specific application. In an embodiment where the blast-resistant material 24 is a compliant layer (e.g., complaint cover 26), the thicknesses 60 and 62 may be less. For example, the thicknesses 60 and 62 may each be approximately 0.005 to 0.5, 0.01 to 0.25, or 0.05 to 0.1 inches thick. In such an embodiment, the metallic layer 50 and/or the polymer layer 52 may be a foil or other thin sheet. Additionally, in any embodiment, the thicknesses 60 and 62 may be the same, or they may be different.

Figure 3:
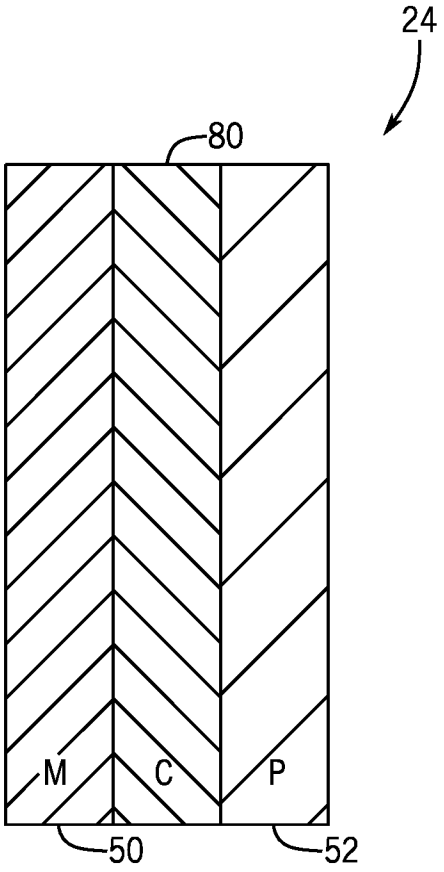
FIG. 3 is a schematic side view of a blast-resistant material, which may be used to form a blast-resistant barrier, in accordance with an embodiment of the present disclosure.

FIG. 3 is a schematic side view of the blast-resistant material 24, illustrating the metallic layer 50, the polymer layer 52, and a coating layer 80 disposed between the metallic layer 50 and the polymer layer 52. For example, the coating layer 80 may be coupled to the metallic layer 50 and the polymer layer 52 via an adhesive or other coupling feature. The coating layer 80 may be a surface treatment or coating that makes the blast-resistant material 24 suitable for certain operating environments. For example, the coating layer 80 may be a corrosion resistant coating, a diamond coating, a hard carbon coating, a thermal diffusion coating, or other coating that improves the performance of the blast-resistant material 24 and/or makes the blast-resistant material 24 more suitable for use in a particular environment. In one embodiment, the coating layer 80 may make the blast-resistant material 24 suitable for use in an environment where the mineral extraction system 12 is located. For example, a coating layer 80 that is a corrosion resistant coating may reduce corrosion of the blast-resistant material 24 (e.g., the metallic layer 50) if the blast-resistant material 24 is exposed to chemicals, minerals, liquids, gases, or other elements that may be present during operation of the mineral extraction system 12 and/or during operation of the pressure containing component 10.

Figure 4:
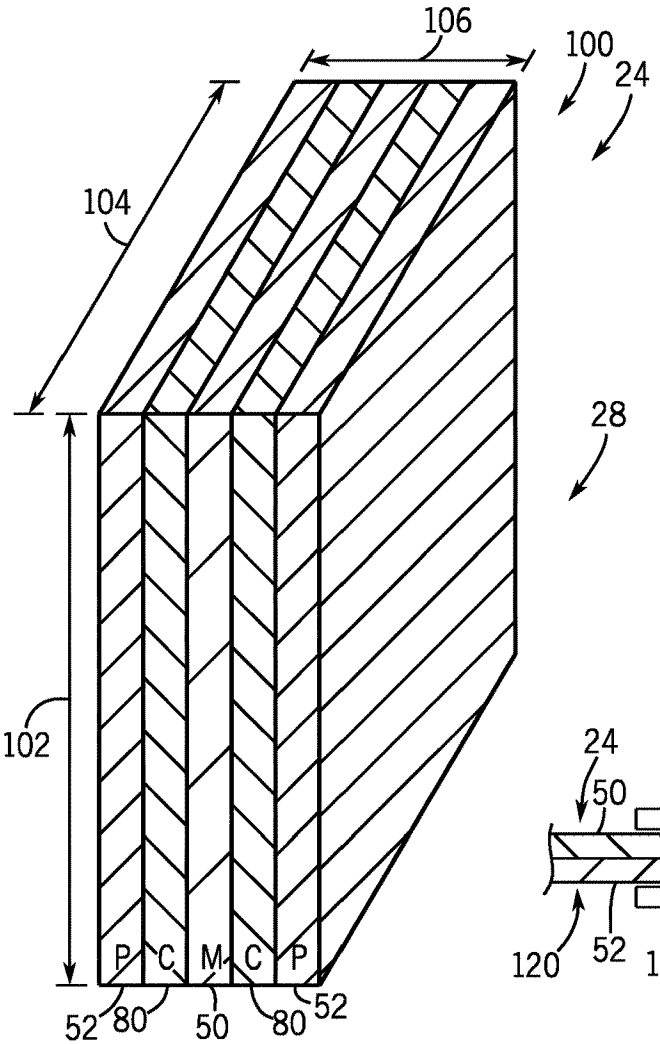
FIG. 4 is a schematic perspective view of a blast-resistant material, which may be used to form a blast-resistant barrier, in accordance with an embodiment of the present disclosure.

FIG. 4 is a schematic perspective view of another embodiment of the blast-resistant material 24. Specifically, the illustrated embodiment is a panel 100 of a rigid layer 28 formed with the blast-resistant material 24. The panel 100 includes the metallic layer 50 with coating layers 80 disposed on both sides of the metallic layer 50. Polymer layers 52 are further disposed on the sides of the coating layers 80 opposite the metallic layer 50. In other words, the metallic layer 50 is captured or "sandwiched" by the coating layers 80, and the coating layers 80 are captured or "sandwiched" by the polymer layers 52.

In the illustrated embodiment, the panel 100 has a height 102, a width 104, and a thickness 106. The height 102, width 104, and thickness 106 may be selected based on a particular application or use of the panel 100. In embodiments where the panel 100 is used as a component of a rigid structure (e.g., a wall of a bunker or other enclosure used for pressure testing of the pressure containing component 10, such as rigid layers 28), the panel 100 may be sized to form a wall panel. For example, the height 102 may be approximately 3, 4, 5, 6, 7, 8 feet, or more, and the width 104 may be approximately 1, 2, 3, 4, 5, 6 feet or more. In embodiments where the panel 100 is a compliant layer (e.g., complaint cover 26), the height 102 and/or width 104 of the panel 100 may be different. For example, the height 102 may be approximately 4, 5, 6, 7, 8, 9, 10, 11, 12 feet, or more, and the width 104 may be approximately 1, 2, 3, 4, 5, 6, 7, 8, 9, 10 feet or more.

Figure 5:
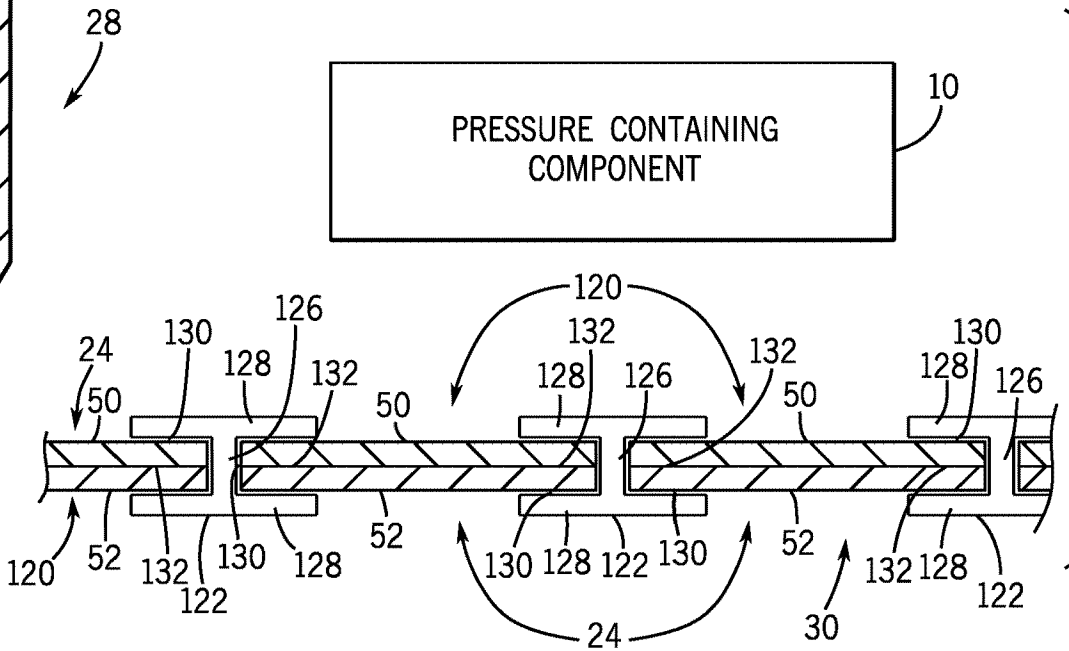
FIG. 5 is a partial cross-sectional top view of a pressure containing component disposed within a blast-resistant enclosure having a blast-resistant material, in accordance with an embodiment of the present disclosure.

FIG. 5 is a partial cross-sectional top view of the pressure containing component 10 disposed within the blast-resistant enclosure 30 formed using the blast-resistant material 24. In particular, the enclosure 30 is formed using multiple panels 120 made of the blast-resistant material 24. Each of the panels 120 may be a square, rectangular, or other suitably shaped panel that may be held in place by one or more supports 122. The supports 122 and the panels 120 cooperatively define an inner volume 124 (see FIG. 1) of the enclosure 30.

As discussed above, the pressure containing component 10 may be positioned within the enclosure 30 during pressure testing (or other testing) of the pressure containing component 10. For example, the pressure containing component 10 may be a valve, choke, subsea tree, compressor, turbomachine, or other component configured to withstand and retain pressure within an inner volume of the component 10. The blast-resistant material 24 of the panels 120 functions to contain potential projectiles or other debris that may disperse in the event of deterioration in the pressure containing performance of the pressure containing component 10. For example, the pressure containing component 10 may be pressurized internally until the pressure containing capabilities of the pressure containing component 10 degrade. In such an event, potential projectiles or other debris of the pressure containing component 10 that may disperse may be blocked or contained by the panels 120.

The blast-resistant material 24 of the panels 120 may also absorb the kinetic energy of the projectiles. In particular, the metallic layer 50 (e.g., the composite material 54) of the blast-resistant material 24 may absorb the force or kinetic energy of the projectile and distribute the force across the entire or substantially across the entire metallic layer 50 (e.g., across the entire substantially across the entire dimensions of the metallic layer 50) of the blast-resistant material 24 without plastically deforming the metallic layer 50. As discussed above, the metallic layer 50 has zero or substantially zero elongation. Thus, the kinetic energy of projectiles contacting the blast-resistant material 24 may be absorbed by the metallic layer and converted into thermal energy without plastic deformation of the blast-resistant material 24.

Moreover, the polymer layer 52 of the blast-resistant material 24 may further enable absorption of kinetic energy from projectiles within the inner volume 124 of the enclosure 30. For example, the polymer layer 52 may have high damping characteristics that enable energy (e.g., kinetic energy) absorption. Further, while the present embodiments illustrates panels 120 with the metallic layer 50 exposed to the inner volume 124 of the enclosure, other embodiments may have panels 120 with polymer layer 52 exposed to the inner volume 124.

As mentioned above, the panels 120 of the enclosure 30 are supported by supports 122. The supports 122 may be any suitable structure configured to withstand the blast forces and moments that are transmitted from the panels 120 to the supports 122. The supports 122 hold the panels 120 in place to form the enclosure 30. In the illustrated embodiment, the supports 122 are I-beams (e.g., steel I-beams). However, in other embodiments, the supports 122 may have other configurations or geometries (e.g., H-beam, flanges, bars, etc.). As shown in FIG. 5, the I-beams include a central member 126 and two end members 128 on opposite sides of the central member 126 to form an "I" shape. The central member 126 and the two end members 128 cooperatively form recesses 130. As shown, ends 132 of the panels 120 may be positioned and retained within one of the recesses 130 of one of the I-beams (e.g., supports 122). In this manner, the I-beam supports 122 may hold the panels 120 in an upright position to create the enclosure 30 and define the inner volume 124 of the enclosure 30. The panels 120 may rest within the recesses 132 without additional mechanical fastening, or the panels 120 may be secured within the recesses 132 (e.g., by bolts, wedges, or other suitable retaining features). As will be appreciated, the enclosure 30 formed using the panels 120 formed from the blast-resistant material 24 and supported by the supports 122 may be more lightweight and cost-effective than traditional bunkers or enclosures used to test pressure containing components 10. For example, present embodiments may not use large amounts of other materials (e.g., concrete, steel, etc.) that may be traditionally used to form traditional bunkers or enclosures.

As discussed above, the disclosed embodiments include the blast-resistant material 24, which may be used to form a barrier (e.g., rigid enclosure 30 or compliant cover 26) about the pressure containing component 10. For example, the blast-resistant material 26 may be polymer based, metallurgical based, additive manufactured based, a hybrid material, or a combination thereof. The blast-resistant material 26 may also be rigid or compliant. In other words, the blast-resistant material 26 may be a stiff and/or inflexible barrier (e.g., a sheet or panel 120), or the blast-resistant material may be a pliable sheet (e.g., a blanket or wrap) configured to conform to the pressure containing component 10. The blast-resistant material 24 may be used to create a barrier about or around the pressure containing component 10, which may be a component of the mineral extraction system 12, such as a choke, valve, tree, compressor, or other turbomachine.

In certain embodiments, the blast-resistant material 24 may be used to create the enclosure 30 surrounding the pressure containing component 10 during pressure testing (or other testing) of the pressure containing component 10. In other embodiments, the blast-resistant material 24 may be used to create a shield around the pressure containing component 10 during use of the pressure containing component 10 in the field. The blast-resistant material 24 functions to contain potential projectiles or other debris that may disperse in the event of deterioration in the pressure containing performance of the pressure containing component 10. In particular, the blast-resistant material 24 has improved energy absorption capabilities over traditional materials. Additionally, the blast-resistant material 24 may be more lightweight, maneuverable, and/or otherwise suitable for mineral extraction system 10 applications over existing materials and systems. In particular, the metallic layer 50 of the blast-resistant material has material properties, such as zero or substantially zero elongation, that enable the metallic material 50 to absorb kinetic energy from a projectile and convert the kinetic energy into thermal energy without plastically deforming. Additionally, the polymer material 52 of the blast-resistant material 24 has high damping characteristics, which further improve the energy absorbing characteristics of the blast-resistant material 24.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the invention as defined by the following appended claims.

The invention claimed is:

1. A system, comprising:

an enclosure having a wall disposed about an inner volume, wherein the wall comprises a blast-resistant material, comprising:

a metallic layer, wherein the metallic layer has substantially zero elongation; and a polymer layer coupled to the metallic layer; and a fluid pressure containing component disposed within the inner volume of the enclosure, wherein an exterior surface of the fluid pressure containing component faces an interior surface of the enclosure, the wall comprising the blast-resistant material is a pliable sheet to conform to a shape of the fluid pressure containing component, and the enclosure is separable or at least partially spaced apart from the fluid pressure containing component;

wherein the blast-resistant material completely blocks and absorbs energy from one or more projectiles resulting from a blast event caused by a structural failure of the fluid pressure containing component due to internal fluid pressure, wherein the blast-resistant material distributes the energy across the metallic layer, and polymer layer further absorbs the energy and helps resist fragmenting of the metallic layer.

2. The system of claim 1, wherein the metallic layer comprises a reinforcing material distributed within a matrix material.

3. The system of claim 2, wherein the reinforcing material comprises a plurality of spherical glassfibers.

4. The system of claim 2, wherein the matrix material comprises aluminum, and the reinforcing material comprises a plurality of fibers.

5. The system of claim 4, wherein the wall comprising the blast-resistant material comprises a corrosion resistant layer coupled to the metallic layer.

6. The system of claim 5, wherein the corrosion resistant layer is disposed between the metallic layer and the polymer layer.

7. The system of claim 1, wherein the fluid pressure containing component comprises a valve, a choke, a mineral extraction tree, or any combination thereof, configured to flow a fluid along a fluid flow path, wherein the interior surface of the enclosure is at least partially spaced apart from the exterior surface of the fluid pressure containing component.

8. The system of claim 1, wherein the enclosure comprises a plurality of panels each comprising the blast-resistant material, the enclosure comprises one or more support structures, and each support structure comprises first and second panel receptacles to receive respective first and second panels of the plurality of panels.

9. The system of claim 1, wherein the blast-resistant material excludes ceramic materials.

10. The system of claim 1, wherein the structural failure comprises breakage of the fluid pressure containing component into pieces defining the one or more projectiles being forced away from the fluid pressure containing component toward the wall comprising the blast-resistant material.

11. The system of claim 1, wherein the pliable sheet comprises a blanket, and the pliable sheet is separable from the fluid pressure containing component.

12. A system, comprising:

a mineral extraction component having a fluid cavity; and a pliable sheet having a wall comprising a blast-resistant material disposed at least partially about and spaced apart from an exterior surface of the mineral extraction component, wherein the pliable sheet conforms to a shape of the mineral extraction component, wherein the wall of the blast-resistant material comprises:

a first metallic layer comprising a matrix material and a reinforcing material distributed within the matrix material, wherein the first metallic layer is configured to absorb and distribute a force caused by structural failure of the mineral extraction component due to a fluid pressure in the fluid cavity; and a first polymer layer coupled to the first metallic layer, wherein the first polymer layer is configured to help protect the first metallic layer from breaking into multiple pieces in response to the force caused by the structural failure of the mineral extraction component.

13. The system of claim 12, wherein the reinforcing material comprises a plurality of spherical glass fibers, and the matrix material comprises aluminum.

14. The system of claim 12, wherein the mineral extraction component comprises a valve, a choke, a mineral extraction tree, or any combination thereof, configured to flow a fluid along a fluid flow path having the fluid cavity, wherein the wall is separable from the mineral extraction component.

15. The system of claim 12, wherein the wall comprising the blast-resistant material comprises a first corrosion resistant layer disposed between and coupled to the first metallic layer and the first polymer layer.

16. The system of claim 12, wherein the wall comprising the blast-resistant material comprises a second corrosion resistant layer disposed between and coupled to the first metallic layer and a second polymer layer, wherein the first and second corrosion resistant layers are disposed on opposite sides of the first metallic layer, wherein the first and second polymer layers are disposed on the opposite sides of the first metallic layer.

17. A method, comprising:

positioning a surface of a pliable sheet comprising a blast-resistant material at least partially about an exterior surface of a mineral extraction component, wherein the pliable sheet comprising the blast-resistant material is separable from the mineral extraction component or at least partially spaced apart from the exterior surface of the mineral extraction component, wherein the pliable sheet conforms to a shape of the mineral extraction component;

pressurizing an inner volume of the mineral extraction component with a pressurized fluid until a pressure-containing performance of the mineral extraction component degrades; and containing at least one projectile resulting from breakage of the mineral extraction component with the blast-resistant material after the pressure-containing performance of the mineral extraction component degrades.

18. The method of claim 17, wherein containing the at least one projectile with the blast-resistant material comprises converting kinetic energy of the at least one projectile into thermal energy with one or more first layers of the wall, and protecting the one or more first layers of the wall from breaking into multiple pieces with one or more second layers of the wall.

19. The method of claim 17, wherein the blast-resistant material comprises a metallic layer and a polymer layer coupled to the metallic layer, wherein the metallic layer has substantially zero elongation.

20. The method of claim 17, wherein the pliable sheet is separable from the mineral extraction component and at least partially spaced apart from the exterior surface of the mineral extraction component, and the pliable sheet comprises a blanket.

* * * * *